United States Patent [19]

Ochs et al.

[11] 4,453,558

[45] Jun. 12, 1984

[54] PREFABRICATED KNOCK-DOWN AWNING FRAME FOR PACKAGED SHIPMENT

[75] Inventors: George K. Ochs, Arcadia; John R. Eide, Brea, both of Calif.

[73] Assignee: Eide Industries, Inc., Los Angeles, Calif.

[21] Appl. No.: 366,487

[22] Filed: Apr. 8, 1982

[51] Int. Cl.[3] ..... A45F 1/16

[52] U.S. Cl. ..... 135/106; 135/DIG. 9

[58] Field of Search ..... 135/106, 89, 117, 102, 135/87, 100, 107, 901; 52/86; 160/377, 135, 352; 47/17, 19, 26, 29; 272/113

[56] References Cited

U.S. PATENT DOCUMENTS

| | | | |
|---|---|---|---|
| 2,768,823 | 10/1956 | Pack | 272/113 |
| 3,114,376 | 12/1963 | Rexroat et al. | 135/106 |
| 3,424,178 | 1/1969 | Yazaki | 135/DIG. 9 |

FOREIGN PATENT DOCUMENTS

| | | | |
|---|---|---|---|
| 1159914 | 7/1958 | France | 135/106 |

*Primary Examiner*—Richard J. Apley
*Assistant Examiner*—S. R. Crow
*Attorney, Agent, or Firm*—William H. Maxwell

[57] ABSTRACT

An awning frame of dome style and tubular construction comprised of a complement of prefabricated frame members supplied in knock-down condition for shipment and subsequent assembly without the use of tools and held secure by a canvas cover.

4 Claims, 8 Drawing Figures

PREFABRICATED KNOCK-DOWN AWNING FRAME FOR PACKAGED SHIPMENT

BACKGROUND

Awning frames are essentially rigid structures joined to establish corners and bow connections etc. In the past, pipe or comparable tubing has been used for awning frame members, and fittings for joinder of said frame members have been castings or the like of a weight or wall thickness comparable to pipe fittings. Said frame members and fittings have been screwed together and/or held secure by laterally disposed set screws and the like. Characteristically, the prior art awning frames have been comprised of separate pipe or tubing members joined by separate fittings, all of rather heavy cross section, and on-site construction of such prior art awning frames has been the custom, requiring an expert mechanic to make up the frame configuration by cutting and shaping frame members to be joined by selected fittings. Most often, special shapes for ornamental awning configurations have been welded together and are cumbersome and not conducive to prefabrication nor adapted for shipment in ready to assemble form, nor for assembly by the purchaser without the expertice of a mechanic, and further without the help of tools. It is a general object of this invention to provide such an awning frame that can be prefabricated, ordered by a purchaser and shipped to a building site for installation substantially without the need for tools. With the present invention, separate fittings are eliminated and features incorporated in the frame members integral therewith to orient and to secure the same together in assembled relation.

It is an object of this invention to provide frame members of common character to be used in awning structures of distinct design. It is also an object of this invention to provide integral joint features therein which are also of common character to be used in awning structures of distinct design. In carrying out this invention the frame members are restricted to the following: a wall bar, a top bar, a bottom bar, a strut bar, and a bow bar, and all of which are alike and adapted to be prefabricated for the construction such as any one of the awning configurations shown in the drawings and as hereinafter described. As will be described, each frame member is characterized by distinct joint features, for telescoping fit of one member with the other.

It is an object of this invention to provide top bars and bottom bars which can be straight or arcuate, and bow bars which can be either straight or convexly or concavely curved, and all of which are alike and adapted to be formed for the construction such as any one of the awning configurations shown in the drawings and as hereinafter described.

It is also an object of this invention to prefabricate frame members in separate forms for subsequent assembly, whereby the volumetric displacement thereof in packaging them is within practical limits. Particular attention is made to the arcuate and curved members wherein the camber thereof does not exceed for example two feet, and wherein the length thereof does not exceed for example approximately one foot seven inches. The aforesaid limits then determine the dimensional size of packaging to be within the limits set by a public carrier assigned to transport the knocked-down complement of frame members to be subsequently assembled by a purchaser receiving the goods.

It is still another object of this invention to provide a complement of frame members for the construction of an awning frame wherein said members thereof slide together into a rigid frame. In carrying out this invention, telescoping thin walled tubing is employed in prefabricating the frame members including their joint features. Subsequently and after assembly, the awning cover shown tightly embraces the frame assembly to hold it secure and rigidly intact, and all without the use of screw joints, set screws, or any other fastener (there can be exceptions and fasteners used as circumstances may require). It is to be understood that the assembled awning frame is held to or secured to a building structure by conventional fastening devices, as required.

SUMMARY OF INVENTION

This invention relates to awnings and particularly to the frames thereof to be made up in a variety of design configurations. The geometric shapes of the awnings are varied from semi-spherical, to triangular or rectangular with straight or arcuate bow bars, and all of which can be further modified, such as are the awnings shown and described. In accordance with this invention, the wall bar, top bar, bottom bar, strut and bow bars are essentially the same in each of the variety of design configurations. It is the prefabrication of complementary members that are telescopically related to form a rigid structure held secure by the embracement of the essential awning cover. As hereinafter described, each frame member is distinct in its joint means and cooperatively related one with the other for sliding interengagement, end to end and side to end as the case may be.

The foregoing and various other objects and features of this invention will be apparent and fully understood from the following detailed description of the typical preferred forms and applications thereof, throughout which description reference is made to the accompanying drawings.

THE DRAWINGS

PREFERRED EMBODIMENT

Figure 1:
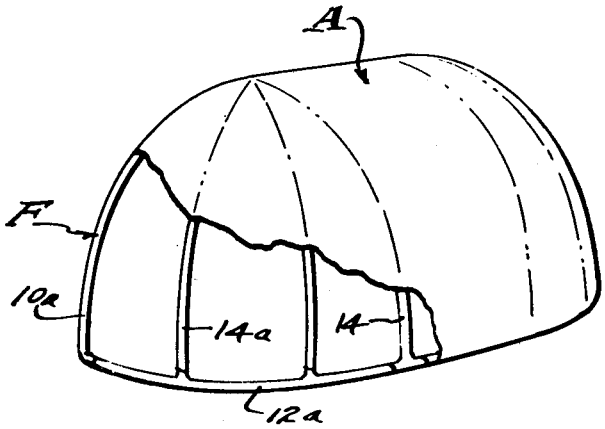
FIG. 1 is a perspective view of an assembled awning with the canvas cover thereof broken away to expose a portion of the frame of the present invention.

Referring now to the drawings, the awning frame F of the present invention is a tubular structure comprised of a complement of prefabricated frame members supplied in knock-down condition for shipment and subsequent basic assembly without the use of tools. As shown in FIG. 1 of the drawings, the awning A is stretched over the frame F to embrace it and thereby secure the complement of frame members including basically, a wall bar, a top bar, a bottom bar, a strut bar, and a bow bar. Additionally, there can be a brace bar. Each of these frame bar members is a prefabricated tube member having telescopic ends of either male or female configuration.

Figure 2:
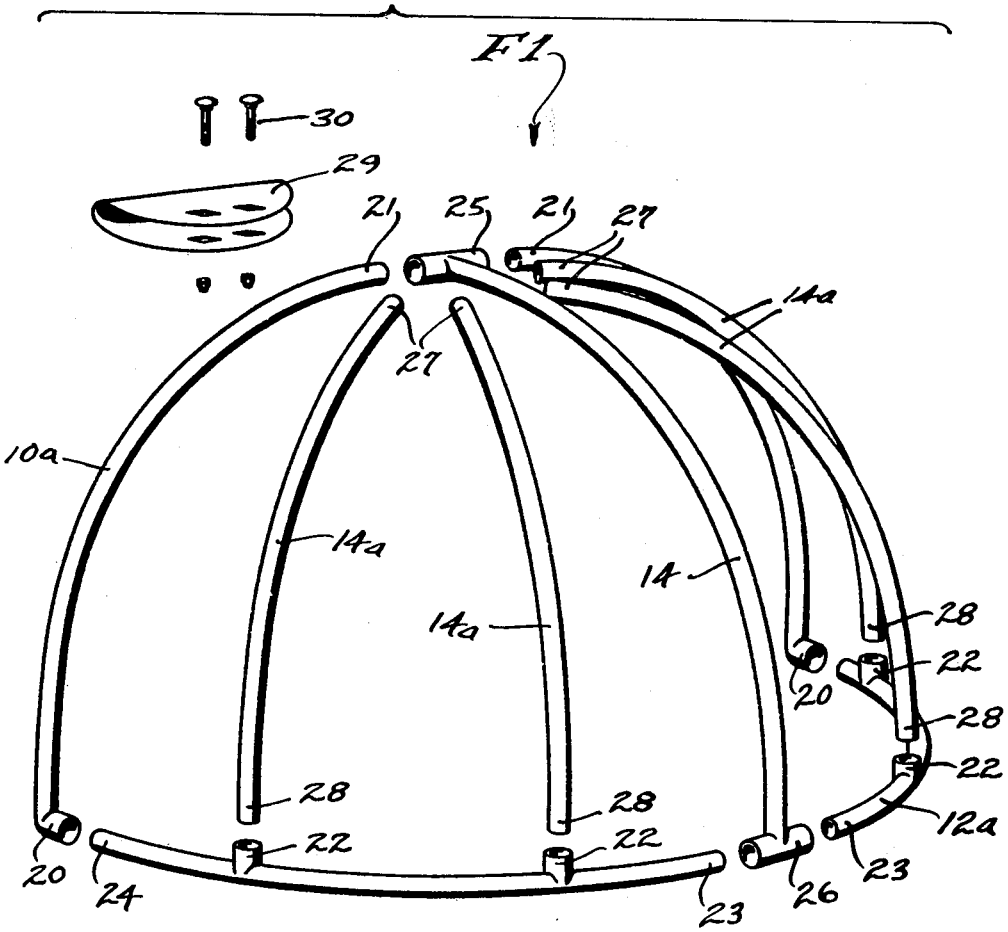
FIG. 2 is an exploded perspective view showing the complementary frame members separated preparatory to assembly into a semi-spherical design configuration.

The semi-spherical awning frame F1 of FIG. 2 includes arcuate wall bars 10*a*, bottom bars 12*a* and bow bars 14*a*. This particular dome style awning design is one quarter of a sphere with the back and bottom planes normal and at a right angle one to the other. A feature of this embodiment is that each frame member is a 90° chord and therefore of equal camber. In practice, the chord length can be eight feet, for example, in which case the camber is one foot seven inches. There are right and left wall bars 10*a* of arcuate form with a right angular forwardly open female coupling part 20 at its bottom end, and with an inwardly projecting male coupling portion 21 at its top end. There is a pair of identical bottom bars 12*a* of arcuate form with at least one or more equally spaced right angular and upwardly open female coupling parts 22, and with inwardly and outwardly projecting male coupling portions 23 and 24 at opposite ends. There is a center bow bar 14 of arcuate form with right angularly oppositely opening female coupling parts 25 and 26 at its top and bottom ends. And, there are identical intermediate bow bars 14*a* of arcuate form with inwardly and downwardly projecting male coupling portions 27 and 28 at its top and bottom ends. The frame members are prefabricated of thin walled telescopically engageable tubing, preferably plated or galvanized steel, whereby the male coupling portions 21, 23, 24, 27 and 28 slideably enter into the female coupling parts 20, 22, 25 and 26.

Figure 7:
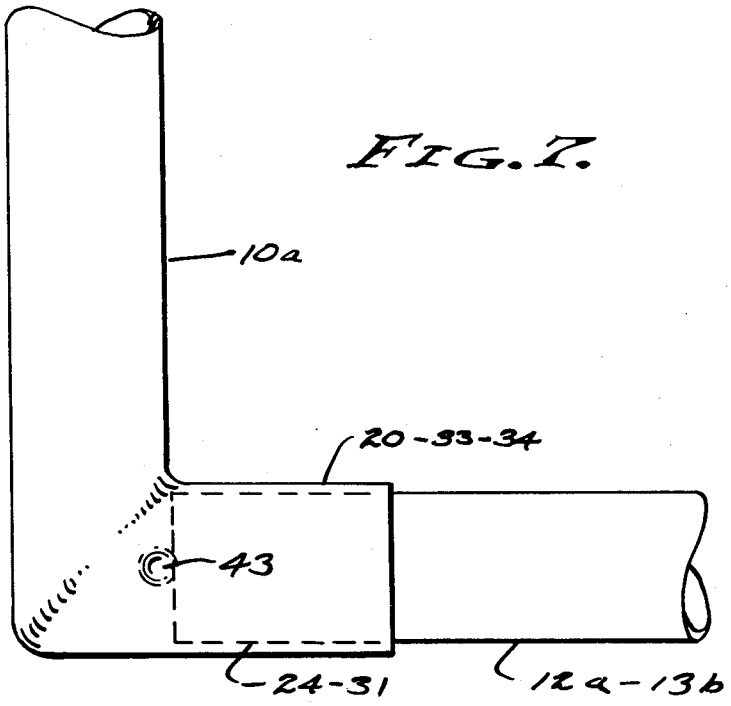
FIG. 7 is an enlarged detailed fragmentary view showing a corner joinder of two frame members. And, FIG. 8 is a view similar to FIG. 7 showing a lateral joinder of two frame members.
Figure 8:
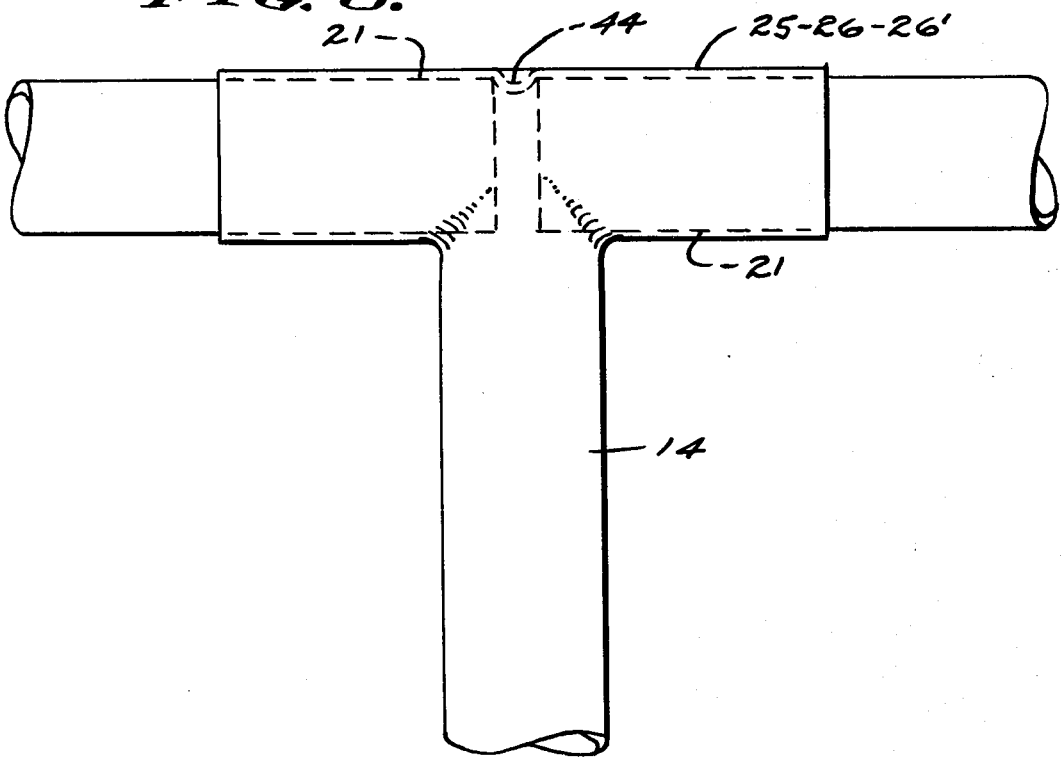

Assembly of the frame F1 of semi-spherical design configuration of FIG. 2 is as follows: The right and left wall bars 10*a* and bottom bars 12*a* are slideably coupled at 20-21, and the assembly thereof is then slideably coupled into the female coupling parts of the center bow bar 14 at 27-28. The telescoped coupling at 20-21 is stopped by a dimple 43 as clearly shown in FIG. 7, while the male coupling portions 27 and 28 have stopped engagement against a dimple 44 as clearly shown in FIG. 8. The intermediate bow bars 14*a* are then slideably coupled into the female parts 22. In practice, the upper male ends of the bow bars 14*a* are embraced by a shell 29 having upper and lower retaining plates through which a screw and nut fastener 30 is passed to clamp the bow bars 14*a* in working position. Further, a brace bar 15 may be assembled onto one of the bottom bars as it is later described and shown in the embodiment of FIG. 5 of the drawings. The awning A secures the assembly by embracing the same.

Figure 3:
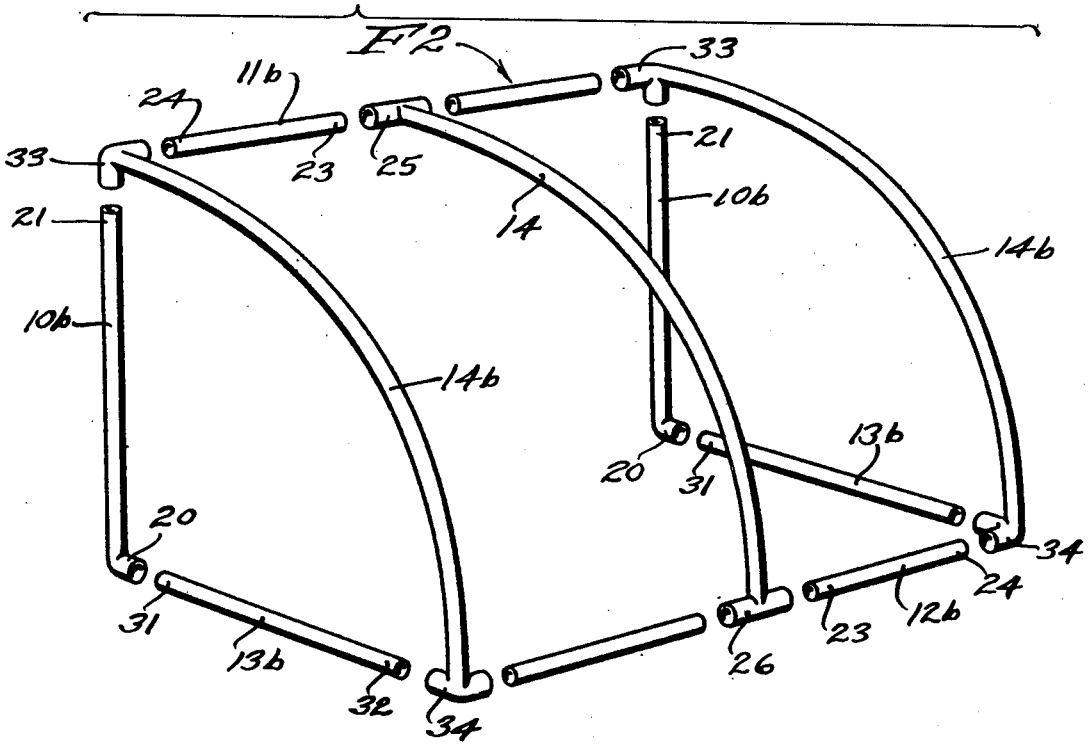
FIG. 3 is a view similar to FIG. 1 preparatory to assembly into a convexely bowed triangular design configuration.

The convexly bowed triangular awning frame F2 of FIG. 3 includes straight wall bars 10*b*, top bars 11*b*, bottom bars 12*b* and strut bars 13*b*. In this embodiment the intermediate and side bow bars 14 and 14*b* are convexly cambered. As in the first embodiment, each bow bar is a 90° chord and therefore of equal camber, the center bow bar 14 being identical to that of the first embodiment. There are right and left wall bars 10*b* of straight form with a right angular forwardly open female coupling part 20 at its bottom end, and with an upwardly projecting male coupling portion 21 at its top end. There is at least a pair of top bars 11*b* and at least a pair of bottom bars 12*b*, all of straight form and identical with oppositely projecting male coupling portions 23 and 24 at opposite ends. There is a pair of identical opposite bottom end strut bars 13*b* with inwardly and outwardly projecting male coupling portions 31 and 32 at opposite ends. There is the center bow bar 14 of convexly arcuate form with right angular oppositely opening female coupling parts 25 and 26 at its top and bottom ends. And, there are identical bow bars 14*b* of convexly arcuate form with right angularly related and opening female coupling parts 33 and 34 disposed in the back and bottom planes respectively. As in the first embodiment, the frame members are prefabricated of thin walled telescopically engageable tubing, preferably plated or galvanized steel, whereby the male coupling portions 21, 23, 24, 31 and 32 slideably enter into the female coupling parts 20, 22, 25 and 26. Assembly of the frame F2 is essentially the same as for frame F1 and a brace bar 15 may be assembled onto one of the bottom bars as it is later described and shown in the embodiment of FIG. 5 of the drawings. However, there are no intermediate bow bars and no clamp shell. The awning A secures the assembly by embracing the same.

Figure 4:
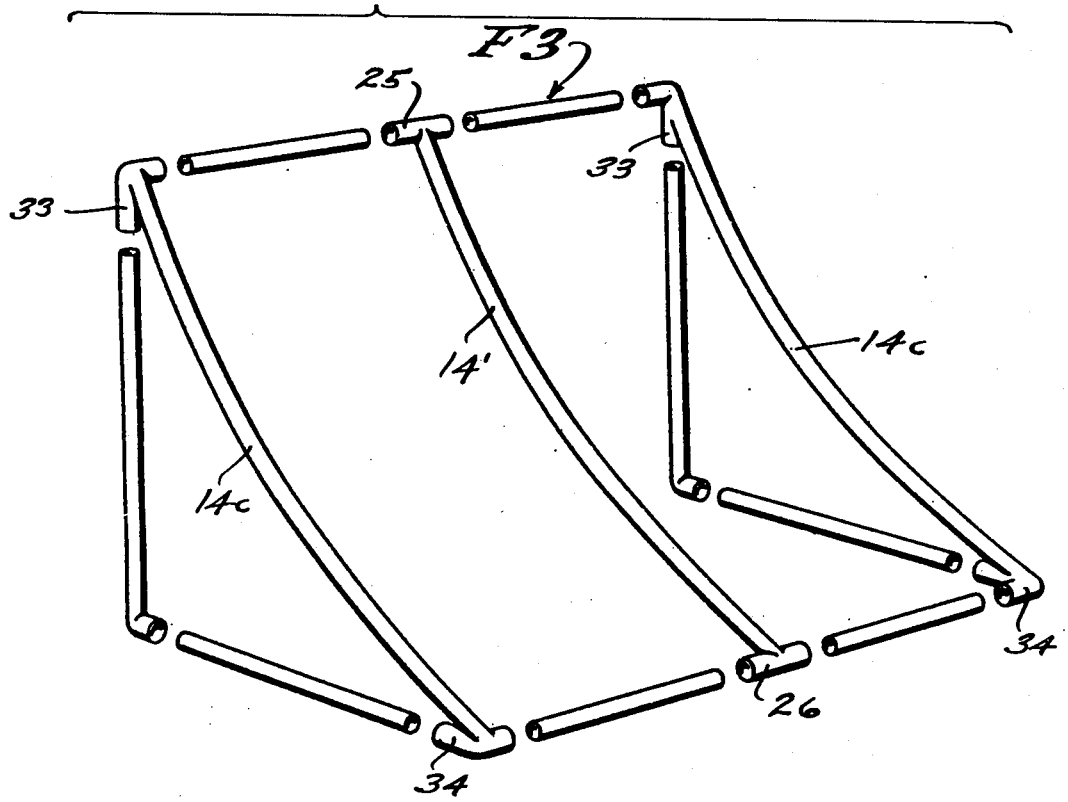
FIG. 4 is a view similar to FIG. 1 preparatory to assembly into a concavely bowed triangular design configuration.

The concavely bowed triangular awning frame F3 of FIG. 4 is the same as the above described frame F2, with the exception of the bow bars 14' and 14*c*. In this embodiment there is a center bow bar 14' of concaved arcuate form with right angular oppositely opening female coupling parts 25 and 26 at its top and bottom ends. And, there are identical end bow bars 14*c* of convexly arcuate form with right angularly related female coupling parts 33 and 34 disposed in the back and bottom planes respectfully. Assembly of the frame F3 is the same as for the frame F2, with or without brace bar 15.

Figure 5:
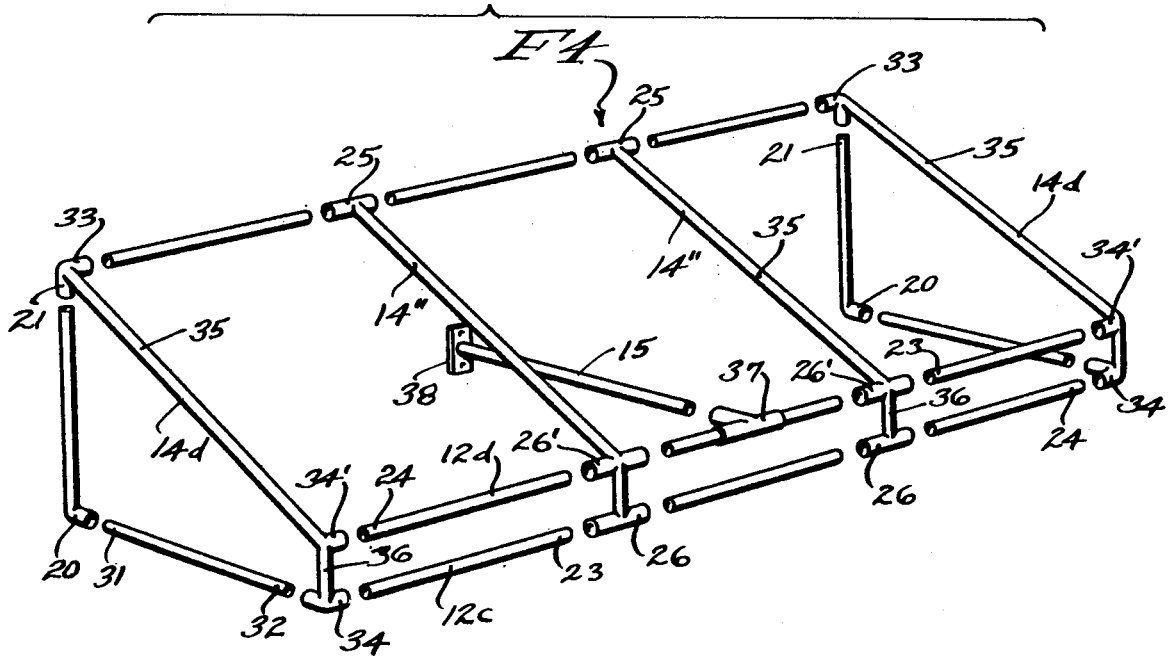
FIG. 5 is a view similar to FIG. 1 preparatory to assembly into a truncated triangular design configuration.

The straight bowed and truncated triangular awning frame F4 of FIG. 5 is the same as the above described frames F2 and F3, with the exception of the bow bars 14'' and 14*d*, and the addition of parallel bottom bars 12*d* above the bottom bars 12*c*. Also, there is a brace bar 15 when so desired. In this embodiment the bow bars 14'' and 14*d* are angular with a slanted portion 35 integral with a front drop portion 36, in each instance. There are intermediate bow bars 14'' of said angular form with right angular oppositely opening female coupling parts 25 at their top ends, and spaced parallel female coupling parts 26 and 26' at their lower ends. The coupling parts 26 and 26' embrace the aforesaid drop portions 36. The coupling parts 26 and 26' receive the coupling portions 23 and 24 of the bottom bars 12*d* and 12*c*. The end bow bars 14*d* are also angular with a slanted portion 35 integral with a drop portion 36, in each instance. The end bow bars 14*d* have right angularly related female coupling parts 33 disposed at the back plane, and have spaced parallel female coupling parts 34 and 34' at their lower ends. Coupling part 34 is at the bottom plane. The coupling parts 34 and 34' embrace the aforesaid drop portions 36. Assembly of the frame F4 is essentially the same as hereinabove described, except for the additional parallel bottom bars 12*d*. As may be required, the brace bar 15 extends from one of the bottom bars 12*c* or 12*d* to bear against the building structure, and has a right angular female coupling part 37 that slideably receives a bottom bar and has a right angular pad 38 for fastening to the supporting building structure.

Figure 6:
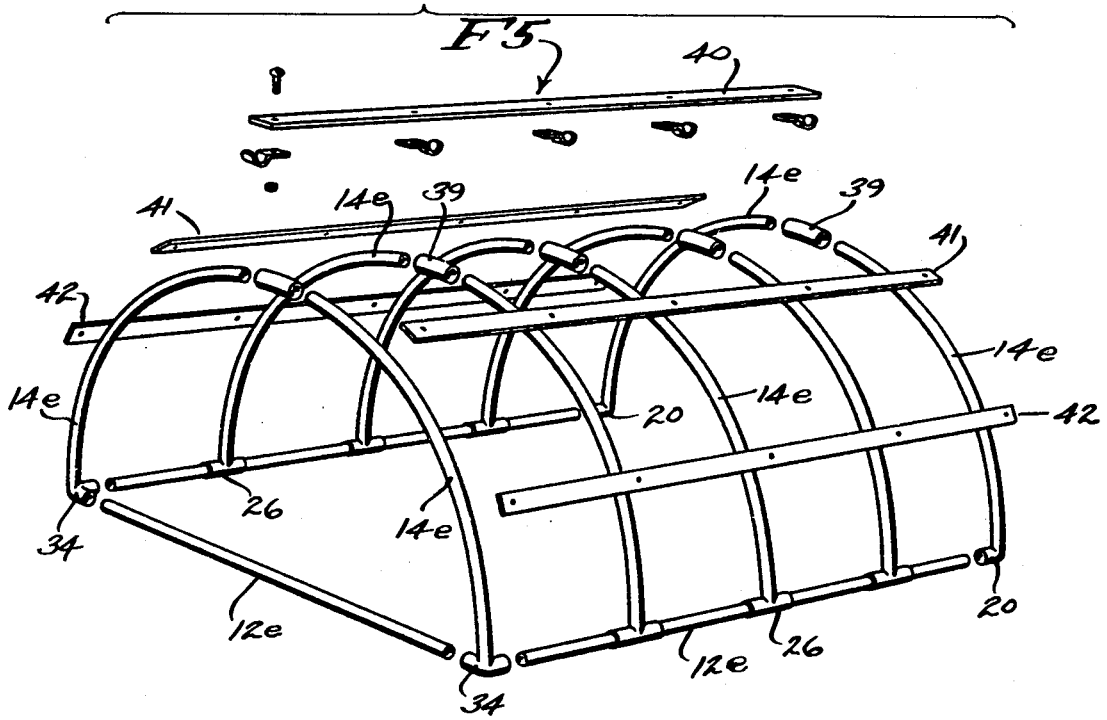
FIG. 6 is a view similar to FIG. 1 preparatory to assembly into a semi-cylindrical design configuration.

The convexly bowed and truncated cylindrical awning frame F5 of FIG. 6 is similar to the above described frames F1–F4 in that the frame members thereof are joined by right angular and oppositely opening female coupling parts. In this embodiment the bow bars 14*e* are again 90° chords of the same camber, and they extend between opposite side bottom bars 12*e*. In this embodiment the pairs of convexly arcuate bow bars each have a female coupling part 20, 26 or 34, and they are joined by separate female ridge coupling parts 39. The coupling parts 39 of the spaced bow bars are held spaced by a ridge slat 40, there being additional side slats 41 and 42 as may be required. The pair of bow bars 14*e* at the back plane have female coupling parts 20, while the bow bars 14*e* at the front of the frame F5 have angularly related female parts 34, all as hereinabove described. The front pair of bow bars 14*e* are spaced by a front bottom bar 12*e*, as shown. Assembly is as above described, by sliding the male coupling portions into the closely fitting female coupling parts, with or without the brace bar 15.

The awning frame members hereinabove described are prefabricated of steel tubing or the like, of two telescopically related diameters, so that one slides within the other. The female coupling parts are open ended so as to receive the projecting male coupling portions, the female parts being welded or otherwise made integral with the bar members as shown. Only the female coupling part 39 is not necessarily part of a bar member, though it may be made integral with either one of the male coupling portions which it received, if so desired. After assembly of the slideably related complements as they are described herein, the cover A is installed to maintain and secure the integrity of the finished awning.

Having described only the typical preferred form and applications of our invention, we do not wish to be limited or restricted to the specific details herein set forth, but wish to reserve to ourselves any modifications or variations that may appear to those skilled in the art as set forth within the limits of the following claims.

We claim:

1. A knock-down awning frame comprised of a prefabricated complement of frame members and including:

an arcuate wall bar frame member for each side of a frame assembly and to be engageably supported by a vertical structure and each having inwardly projecting male coupling portions at its top end and a right angular open female coupling part at its bottom end, an arcuate bottom bar frame member for each side of said frame assembly and to be disposed in a horizontal bottom plane and each having inwardly and outwardly projecting male coupling portions and the outwardly projecting male coupling portion being slideably received in the open female coupling part at the bottom end of a wall bar, and at least one arcuate bow bar frame member disposed in a vertical plane between the top ends of the wall bars and inner ends of the bottom bars and having oppositely opening female coupling parts right angularly at its top and bottom ends, the inwardly projecting male coupling portions of the bottom bars of each side of the frame assembly formed thereby being slideably received in the open female bottom end coupling parts of the said at least one bow bar and the inwardly projecting male coupling portions of the wall bars of the frame assembly formed thereby being slideably received in the open female top end coupling parts of said at least one bow bar, the frame assembly being held secure by a cover.

2. The knock-down prefabricated awning frame as set forth in claim 1, wherein a center bow is arcuate and extends between its top and bottom female coupling parts slideably receiving the inwardly projecting male coupling portions of the wall bars and bottom bars, and wherein at least one intermediate bow bar is slideably received in said at least one female coupling part projecting from the bottom bars to extend upwardly to the top end of the center bow bar.

3. The knock-down prefabricated awning frame as set forth in claim 1, wherein a center bow is arcuate and extends between its top and bottom female coupling parts slideably receiving the inwardly projecting male coupling portions of the wall bars and bottom bars, wherein at least one intermediate bow bar is slideably received in said at least one female coupling part projecting from the bottom bars to extend upwardly to the top end of the center bow bar, and wherein a clamp shell comprised of top and bottom plates embraces the upper ends of the wall bars and bow bars.

4. The knock-down prefabricated awning frame as set forth in any one of claims 1, 2, or 3, wherein the wall bars, bottom bars and bow bars each extend through a 90° arc and are of equal camber.

* * * * *